United States Patent [19]

Krahn

[11] Patent Number: 4,850,538

[45] Date of Patent: Jul. 25, 1989

[54] ADJUSTABLE NOZZLE

[75] Inventor: Roy J. Krahn, Village of Birchwood, Minn.

[73] Assignee: Minnesota Mining and Manufacturing Company, Saint Paul, Minn.

[21] Appl. No.: 109,920

[22] Filed: Oct. 19, 1987

[51] Int. Cl.[4] ..... B05B 1/34

[52] U.S. Cl. ..... 239/439; 239/458; 239/562; 239/568; 239/DIG. 1

[58] Field of Search ..... 239/438–441, 239/456–458, 562, 568, DIG. 1, DIG. 13

[56] References Cited

U.S. PATENT DOCUMENTS

| | | | |
|---|---|---|---|
| 568,876 | 10/1896 | Regan . | |
| 600,065 | 3/1898 | Evans . | |
| 692,571 | 2/1902 | Wieman | 239/440 |
| 699,801 | 5/1902 | Martin | 239/457 |
| 780,780 | 1/1905 | Culley . | |
| 871,663 | 11/1907 | Ball . | |
| 1,120,760 | 12/1914 | Tatum | 239/562 |
| 1,140,462 | 5/1915 | Johnson . | |
| 1,304,384 | 5/1919 | Schlatter . | |
| 2,148,726 | 11/1937 | Brandt | 43/148 |
| 2,218,411 | 10/1940 | Albach et al. | 239/441 |
| 2,546,120 | 2/1947 | Boroughs | 299/145 |
| 2,571,763 | 10/1951 | Robbins | 239/DIG. 1 |
| 3,139,100 | 1/1962 | Griparis | 134/169 |
| 3,241,773 | 2/1964 | Travis | 239/436 |
| 3,377,029 | 4/1968 | Montgomery | 239/457 |
| 4,251,573 | 2/1981 | Holm et al. | 427/236 |

FOREIGN PATENT DOCUMENTS

| | | | |
|---|---|---|---|
| 104180 | 9/1937 | Australia | 239/456 |
| 592910 | 10/1947 | United Kingdom | 239/568 |

*Primary Examiner*—Andres Kashnikow
*Assistant Examiner*—Michael J. Forman
*Attorney, Agent, or Firm*—Donald M. Sell; Walter N. Kirn; William L. Huebsch

[57] ABSTRACT

A nozzle for spraying rust proofing material onto automobile panels including an elongate inner tube having an inlet end and axially spaced radially extending slots positioned to provide portions of the slots entirely encircling the tube. A blocking member has an arcuate blocking portion extending about 180 degrees around the outer surface of the inner tube and fixed at one end of a support portion mounted around the outer surface of the inner tube for movement between an open position spaced from the slots so that material entering the inner tube through the inlet opening under pressure will be sprayed through the slots in an arc of 360 degrees radially around the inner tube, and partially closed positions with the blocking portion covering the slots around about 180 degrees of the periphery of the inner tube so that material entering the inner tube through the inlet opening under pressure will be sprayed through the slots in an arc of about 180 degrees radially around the inner tube in a direction opposite the blocking portion.

7 Claims, 2 Drawing Sheets

ADJUSTABLE NOZZLE

TECHNICAL FIELD

The present invention relates to nozzles of the types adapted for spraying materials either in arcs or in entire circles around the peripheries of the nozzles.

BACKGROUND ART

Nozzles such as are used to spray rust proofing material onto automobile panels are known which can spray materials onto surfaces around the nozzles. U. S. Pat. No. 4,251,573 provides an illustrative example. Such known nozzles typically comprise a tube having an axis, an inner surface defining a central cavity, axially spaced terminal and inlet ends with the inlet end defining an inlet opening to the central cavity, and one or more radially extending slots extending between the inner and outer surfaces of the inner tube. Some such nozzles which are designed to spray in an entire circle around the periphery of the nozzle have two such slots which are axially spaced and positioned circumferentially to provide a portion of at least one of the slots on every side of the tube; whereas other such nozzles that are adapted for spraying material in only an arc such as an 180 degree arc from only one side of the nozzle have only one slot on the side of the nozzle toward which material is to be sprayed. Spraying rust proofing materials onto the different panels of an automobile has typically required the use of several such nozzles that provide different spray patterns. For example, when material is being sprayed between the panels in an automobile door it is often desirable to spray material to only one side of the nozzle to restrict the amount of material that is sprayed onto the window mechanism; whereas when material is sprayed between other body panels such as in the fenders it is often desirable to spray material entirely around the nozzle. Thus, the workman spraying rust proofing material onto panels is required to change nozzles to provide the desired spray pattern and direction for different parts of the automobile.

DISCLOSURE OF INVENTION

The present invention provides a single adjustable nozzle for spraying material such as rust proofing material onto automobile panels that can be adjusted to either spray in a 360 degree circle around the periphery of the nozzle, or to spray in only a predetermined arc on any side of the nozzle so that a workman need only adjust the nozzle rather than change nozzles to spray rust proofing material in different patterns onto automobile panels in different portions of an automobile.

The nozzle according to the present invention for spraying materials includes (1) an elongate inner tube having an axis, an inner surface defining a central cavity, axially spaced terminal and inlet ends with the inlet end defining an inlet opening to the central cavity, and at least two axially spaced radially extending slots, the slots extending between the inner and outer surfaces of the inner tube and being positioned circumferentially to provide a portion of at least one of the slots on every side of the tube; (2) a blocking member including a tubular support portion around the outer surface of the inner tube having a central axis and opposite axially spaced ends, and an arcuate blocking portion coaxial with and fixed at one end of the support portion and extending around a predetermined portion (e.g., 180 degrees) of the outer surface of the inner tube; and (3) means for mounting the tubular support portion of the blocking member on the inner tube to afford movement of the blocking portion between open positions spaced from the slots so that material entering the inner tube through the inlet opening under pressure will be sprayed through the slots in an arc of 360 degrees radially around the inner tube, and partially closed positions with the blocking portion covering the slots around the predetermined portion of the periphery of the inner tube so that material entering the inner tube through the inlet opening under pressure will be sprayed through the slots in an arc radially around the inner tube only in a direction opposite the blocking portion.

The nozzle according to the present invention can have different numbers of slots including two slots each extending for at least 180 degrees on opposite sides of the inner tube, or three slots each extending for more than about 180 degrees around different portions of the inner tube. Also the slots may be oriented at different angles with respect to the axis of the inner tube from 90 degrees to less than 45 degrees with respect thereto.

Also, various means may be used to mount the blocking member on the inner tube including threads formed on the inner tube and the tubular support portion and in threaded engagement to afford movement of the blocking portion between its open and partially closed positions by manual rotation of the blocking member relative to the inner tube to move the blocking member both axially of and around the periphery of the inner tube; or the outer surface of the inner tube having generally cylindrical outer surface portions, and the tubular support portion having an inner surface in frictional engagement with at least one of the cylindrical outer surface portions and being axially and rotatably movable on the cylindrical outer surface portions to afford manual movement of the blocking portion between its open and partially closed positions.

BRIEF DESCRIPTION OF DRAWING

The present invention will be further described with reference to the accompanying drawing wherein like reference numerals refer to like parts in the several views, and wherein.

DETAILED DESCRIPTION

Figure 1:
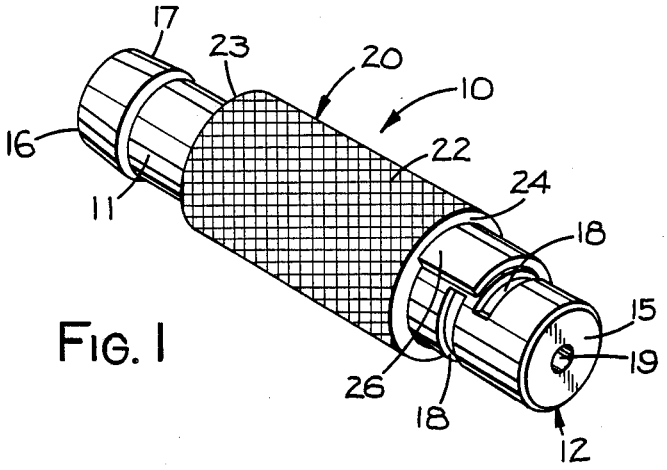
FIG. 1 is a perspective view of a first embodiment of an adjustable nozzle according to the present invention shown with a blocking portion of the nozzle in an open position.
Figure 2:
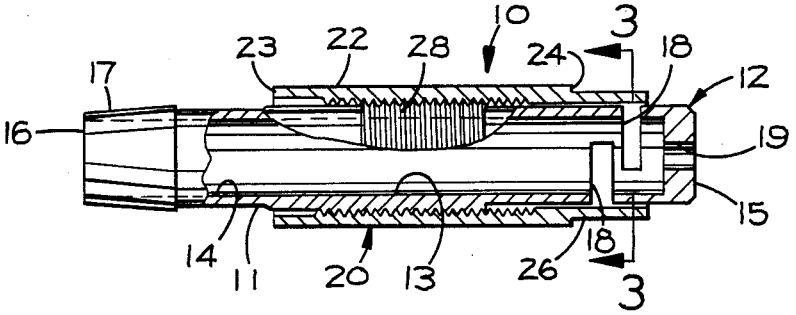
FIG. 2 is a side view of the nozzle of FIG. 1 having parts broken away and sectioned to show detail and shown with the blocking portion of the nozzle in a partially closed position.
Figure 3:
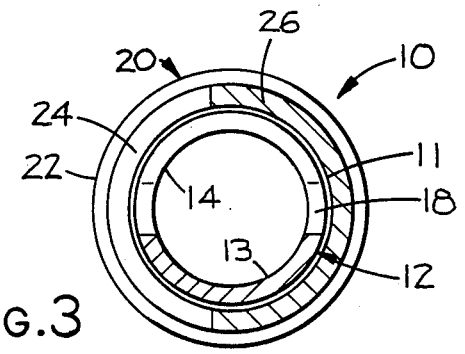
FIG. 3 is a sectional view of the nozzle of FIG. 1 taken approximately along line 3—3 of FIG. 2.

Referring now to FIGS. 1, 2 and 3 of the drawing, there is shown a first embodiment of an adjustable nozzle according to the present invention which is particularly adapted to spray material such as rust proofing material onto automobile panels, and which is generally designated by the reference numeral 10.

Generally the nozzle 10 comprises an elongate cylindrical inner tube 12 which may be of a suitable metal or polymeric material such as brass or the polymeric material sold under the trade designation of "Delrin". The inner tube 12 has an axis, an outer surface 11, an inner surface 13 defining a central cylindrical cavity 14, axially spaced terminal and inlet ends 15 and 16 with the inlet end 16 defining an inlet opening to the central cavity 14, and the terminal end 15 closed by an end wall having a small central through opening 19 that increases air flow through the nozzle 10 but passed only a small amount of the sprayed material. Adjacent frustoconical and cylindrical portions of the outer surface 11 define a hose barb 17 adapted to be pressed into an outlet end of a polymeric material supply tube (not shown). The inner tube 18 also has two axially spaced radially extending slots 18 adjacent its terminal end 15. The slots 18 extend between the inner and outer surfaces 13 and 11 of the inner tube 12, extend for slightly more than 180 degrees each around the inner tube 12 at an orientation of about 90 degrees with respect to the axis of the inner tube 12, and are positioned circumferentially on opposite sides of the inner tube 12 to provide portions of at least one of the slots 18 on every side of the inner tube 12. A blocking member 20 (also of metal or polymeric material) including a cylindrically tubular support portion 22 having a knurled outer surface is positioned around the outer surface 11 of the inner tube 12 between its inlet end 16 and the slots 18 and has a central axis and opposite axially spaced ends 23 and 24, and an axially extending arcuate blocking portion 26 coaxial with and fixed at the end 24 of the support portion 22 and extending about 180 degrees around the outer surface 11 of the inner tube 12. Means in the form of threads 28 formed on the inner tube 12 and on the tubular support portion 22 and in threaded engagement with each other are provided for mounting the tubular support portion 22 on the inner tube 12 to afford by manual rotation of the blocking member 20 movement of the blocking portion 26 between open positions (one of which is illustrated in FIG. 1) spaced from the slots 18 so that material entering the inner tube 12 through the inlet opening under pressure will be sprayed through the slots 18 in an arc of 360 degrees radially around the inner tube 12, and various partially closed positions, one of which is illustrated in FIG. 2, with the blocking portion 26 covering the slots 18 around about 180 degrees of the periphery of the inner tube 12 so that material entering the inner tube 12 through the inlet opening under pressure will be sprayed through the slots 18 in an arc of about 180 degrees radially around the inner tube 12 in a direction opposite the blocking portion 26.

Figure 4:
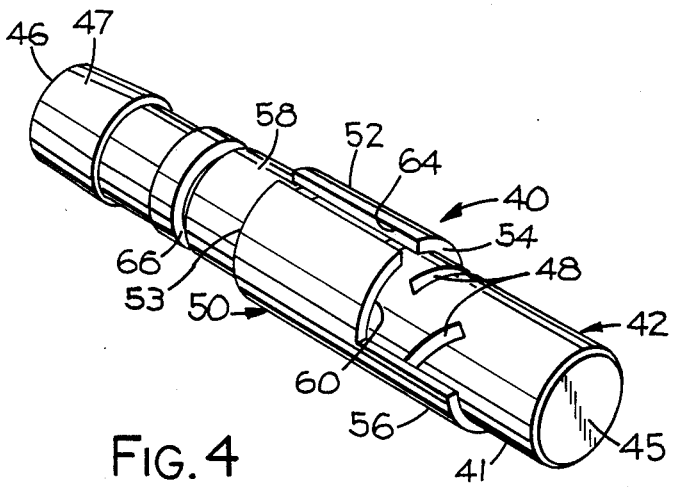
FIG. 4 is a perspective view of a second embodiment of an adjustable nozzle according to the present invention shown with a blocking portion of the nozzle in a partially closed position.
Figure 5:
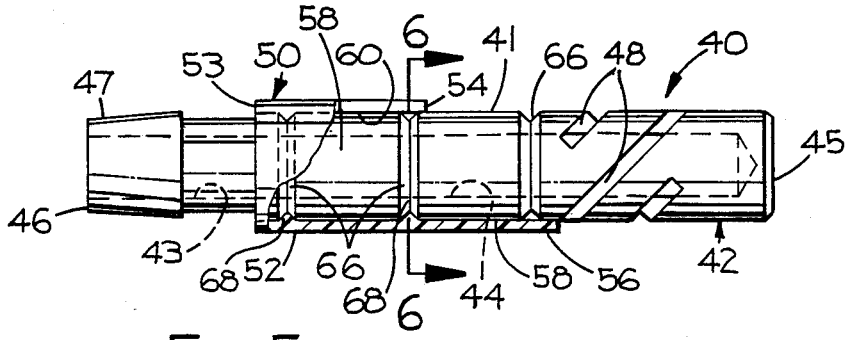
FIG. 5 is a side view of the nozzle of FIG. 4 having parts broken away and sectioned to show detail and shown with the blocking portion of the nozzle in an open position.
Figure 6:
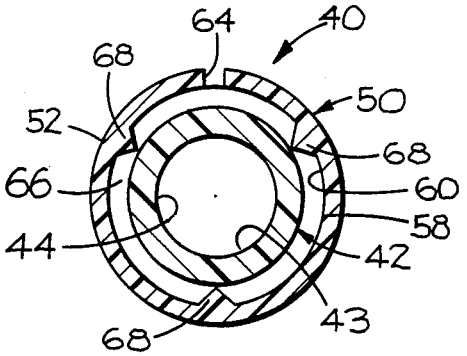
FIG. 6 is a sectional view of the nozzle of FIG. 4 taken approximately along line 5—5 of FIG. 5.

Referring now to FIGS. 4, 5 and 6 of the drawing, there is shown a second embodiment of a nozzle according to the present invention generally designated by the reference numeral 40.

Generally the nozzle 40 comprises an elongate cylindrical inner tube 42 (which may also be of a suitable metal or polymeric material) having an axis, an outer surface 41, an inner surface 43 defining a cylindrical central cavity 44, axially spaced terminal and inlet ends 45 and 46 with the inlet end 46 defining an inlet opening to the central cavity 44, and the terminal end closed by a solid end wall. Adjacent frustoconical and cylindrical portions of the outer surface 41 adjacent the inlet end 46 define a hose barb 47 adapted to be pressed into an outlet end of a polymeric material supply tube (not shown). The inner tube 42 also has three axially spaced radially extending slots 48 adjacent its terminal end. The slots 48 extend between the inner and outer surfaces 43 and 41 of the inner tube 42, extend for more than 180 degrees each circumferentially around the inner tube 42 at an orientation of about 45 degrees with respect to the axis of the inner tube 42, and are positioned on the inner tube 42 to provide portions of at least two of the slots 48 on every side of the inner tube 42. The nozzle also has a blocking member 50 (which may also be of a suitable metal or polymeric material) including a cylindrical tubular support portion 52 positioned around the outer surface 41 of the inner tube 42 between the inlet end 46 and the slots 48, having a central axis and opposite axially spaced ends 53 and 54. The blocking member 50 also includes an axially extending arcuate blocking portion 56 coaxial with and fixed at the end 54 of the support portion 52 and extending about 180 degrees around the outer surface of the inner tube 42. The outer surface 41 of the inner tube 42 has generally cylindrical portions 58. The tubular support portion 52 has a cylindrical inner surface 60 in frictional engagement with at least one of the cylindrical surface portions 58 and is axially and rotatably movable on the cylindrical surface portions 58 to afford movement of the blocking portion 56 by manual axial and rotational movement of the blocking member 50 between (1) open positions (one of which is illustrated in FIG. 5) spaced from the slots 48 so that material entering the inner tube 42 through the inlet opening under pressure will be sprayed through the slots 48 in an arc of 360 degrees radially around the inner tube 42, and (2) various partially closed positions, one of which is illustrated in FIG. 4, with the blocking portion 56 covering the slots 48 around about 180 degrees of the periphery of the inner tube 42 so that material entering the inner tube 42 through the inlet opening under pressure will be sprayed through the slots 48 in an arc of about 180 degrees radially around the inner tube 42 in a direction opposite the blocking portion 56.

Frictional engagement between the inner surface 60 of the tubular support potion 52 and the cylindrical surface portions 58 is provided by an axially extending slit 64 in the tubular support portion 52 on its side opposite the blocking portion 56, and making the normal diameter of the inner surface 60 slightly smaller than the diameter of the cylindrical surface portions 58 so that engagement of the tubular support portion 52 over the cylindrical surface portions 58 requires a slight resilient expansion of the tubular support portion 52.

The nozzle 40 includes retaining means in addition to the friction fit between the support portion 52 and the cylindrical surface portions 58 for helping to retain the blocking portion 56 in one of its positions. That retaining means comprises three axially spaced annular grooves 66 around and partially defining the outer surface 41 of the inner tube 42 at the ends of and between the cylindrical surface portions 58, and detentes in the form of axially spaced rings of radially inwardly extending projections 68 on the tubular support portion 52 adapted to enter either the two grooves 66 adjacent the inlet end 46 of the nozzle 40 to releasably retain the blocking portion 56 in one of its open positions, or to enter the two grooves 66 adjacent the slots 48 to help releasable retain the blocking portion 56 in one of its partially open positions, a desired one of which partially open positions may be then selected by rotating the blocking portion 56 around the inner tube 42 with the projections 68 moving along the grooves 66.

The present invention has now been described with reference to two embodiments thereof. It will be apparent to those skilled in the art that many changes can be made in the embodiments described without departing from the scope of the present invention. Thus the scope of the present invention should not be limited to the structures descried in this application, but only by structures described by the language of the claims and the equivalents of those structures.

I claim:

1. A nozzle for spraying rust proofing material onto automobile panels, said nozzle including an elongate inner tube having an axis, an outer surface, an inner surface defining a central cavity, axially spaced terminal and inlet ends with said inlet end defining an inlet opening to said central cavity, and at least two axially spaced radially extending slots, said slots extending between the inner and outer surfaces of said inner tube in a portion of said inner tube beginning at a first portion and ending at a second position axially of said tube and being positioned circumferentially to provide a portion of at least one of said slots on every side of said tube;

a blocking member including a tubular support portion around the outer surface of said inner tube, having a central axis coincident with said inner tube and having opposite axially spaced ends, and an arcuate blocking portion coaxial with and fixed at one end of said support portion, said arcuate blocking portion having edges parallel to said central axis which edges have an axial length adapted to extend from said first position to said second position, and said blocking portion extending between said edges around about 180 degrees of the outer surface of the inner tube; and means for mounting said tubular support portion on the inner tube to afford movement of said blocking portion between an open position spaced from said slots so that material entering the inner tube through the inlet opening under pressure will be sprayed through the slots in an arc of 360 degrees radially around the inner tube, and partially closed positions with said parallel edges of said blocking portion extending from said first position to said second position with said blocking portion on any side of inner tube to cover said slots around about 180 degrees of the periphery of said inner tube so that material entering the inner tube through the inlet opening under pressure will be sprayed through the slots in an arc radially around the inner tube only in a direction opposite said blocking portion.

2. A nozzle according to claim 1 wherein said inner tube has two of said slots each extending for at least 180 degrees on opposite sides of said inner tube with said slots being oriented at about 90 degrees with respect to the axis of said inner tube.

3. A nozzle according to claim 1 wherein said inner tube has three of said slots each extending for more than about 180 degrees around different portions of said inner tube between said first and second positions with said slots being oriented at about 45 degrees with respect to the axis of said inner tube.

4. A nozzle according to claim 1 wherein said means for mounting comprises threads formed on said inner tube and said tubular support portion and in threaded engagement to afford movement of said blocking portion between said open and partially closed positions by manual rotation of said blocking member relative to said inner tube.

5. A nozzle according to claim 1 wherein said means for mounting comprises said inner tube having generally cylindrical outer surface portions, and said tubular support portion having an inner surface in frictional engagement with at least one of said cylindrical outer surface portions and being axially and rotatably movable on said cylindrical outer surface portions to afford moving said blocking portion between said open and partially closed positions.

6. A nozzle according to claim 5 wherein said nozzle further includes axially spaced annular grooves around and partially defining the outer surface of said inner tube adjacent said cylindrical outer surface portions, and detentes on said tubular support member adapted to enter said grooves and help releasably retain said blocking portion in said open and partially closed positions.

7. A nozzle according to claim 1 wherein said support portion is mounted on said inner tube between said inlet end and said slots.

* * * * *